US007096557B2

(12) United States Patent
Hanna et al.

(10) Patent No.: US 7,096,557 B2
(45) Date of Patent: Aug. 29, 2006

(54) MAKING PANEL REINFORCEMENTS DURING HOT STRETCH FORMING

(75) Inventors: Michael D. Hanna, West Bloomfield, MI (US); Stephen R. Koshorek, Royal Oak, MI (US)

(73) Assignee: General Motors Corporation, Detroit, MI (US)

( * ) Notice: Subject to any disclaimer, the term of this patent is extended or adjusted under 35 U.S.C. 154(b) by 153 days.

(21) Appl. No.: 10/876,130

(22) Filed: Jun. 24, 2004

(65) Prior Publication Data

US 2005/0283965 A1 Dec. 29, 2005

(51) Int. Cl.
*B23P 17/00* (2006.01)

(52) U.S. Cl. ..... 29/423; 29/464; 29/469.5; 72/379.2

(58) Field of Classification Search ..... 29/421.1, 29/423, 464, 465, 469.5, 525.13; 72/57, 72/60, 379.2
See application file for complete search history.

(56) References Cited

U.S. PATENT DOCUMENTS 1,161,191 A * 11/1915 Cook ..... 29/418
3,722,068 A * 3/1973 Manchester et al. ..... 29/423
5,374,388 A * 12/1994 Frailey ..... 264/510
5,492,466 A * 2/1996 Frailey ..... 425/389
5,600,991 A * 2/1997 Munzen ..... 72/348
6,253,588 B1 7/2001 Rashid et al.
6,547,895 B1 4/2003 Bradley et al.
6,550,124 B1 4/2003 Krajewski et al.
6,672,121 B1 * 1/2004 Carsley et al. ..... 72/57
6,843,089 B1 * 1/2005 Krajewski et al. ..... 72/60
6,976,309 B1 * 12/2005 Mayer et al. ..... 29/897.2
2005/0244666 A1 * 11/2005 Van Giezen et al. ..... 428/577

* cited by examiner

*Primary Examiner*—Essama Omgba
(74) *Attorney, Agent, or Firm*—Kathryn A. Marra

(57) ABSTRACT

Small sheet metal reinforcement pieces are co-formed with a larger sheet metal part during a hot stretch forming against a heated forming tool surface. Locator holes are made in blanks for the reinforcing pieces so they can be precisely located on locator pins in the forming surface where the reinforcing pieces are ultimately to be attached to the formed sheet part. A preheated blank of the larger part is stretched against the trapped reinforcement blanks and both the part and reinforcing pieces are shaped against the hot tool. The part and reinforcing pieces are removed and cooled, and the closely fitting reinforcing pieces attached to the part at a suitable later time.

10 Claims, 2 Drawing Sheets

MAKING PANEL REINFORCEMENTS DURING HOT STRETCH FORMING

TECHNICAL FIELD

This invention pertains to hot stretch forming of sheet metal panels with reinforcing patches. More specifically, this invention pertains to locating the sheet metal patch pieces on a forming tool before the sheet metal blank for the panel is stretched against the tool and patches.

BACKGROUND OF THE INVENTION

Hot stretch sheet forming of certain high elongation aluminum alloys has been used to make one-piece body panels for automotive vehicles.

Cold rolled sheets of fine-grain magnesium and manganese containing alloys are heated to a forming temperature in the range of, for example, 400 to 510° C. and stretch formed against a heated forming tool surface into the shape of the panel. A sheet blank is gripped at its edges between the forming surface tool on one side of the sheet and an opposing tool defining a pressure chamber on the other side of the blank. A pressurized working gas is admitted into the chamber stretching and draping the heat softened sheet into compliance with the forming surface. After forming, the pressurized gas is released, the hot tools are parted, and the formed hot sheet product carefully removed from the forming tool to a cooling rack.

The sheet metal blanks are typically about one to three millimeters thick and there is some localized thinning of the sheet material during the stretch forming process. In applications involving the forming of automobile body panels, the original blanks are often generally rectangular with sides three or four feet in length. When a passenger compartment floor pan for a vehicle is to be stretched formed, the blank is considerably larger.

Sometimes a panel design requires reinforcement pieces to be attached at specific locations on a side of the one-piece panel. Such reinforcing pieces are often considerably smaller than the panel to which they are to be attached. These reinforcement sheet pieces may provide local thickening for structural support or for attachments or the like. They have been formed separately and welded or otherwise suitably attached to the formed panel during final assembly. It would be desirable to form the reinforcement pieces when the main panel is being stretch formed so that the reinforcement precisely fits the formed part. However, it is necessary to suitably position reinforcing sheet pieces on the relatively large area tool for forming the hot sheet blank. When a number of parts are being produced successively the forming tool is hot and the reinforcing piece must be positioned on a hot forming surface of the tool.

Accordingly, it is an object of this invention to provide a practice for locating pieces, sometimes relatively small pieces, of sheet metal on a forming tool before a sheet metal blank is gripped over the tool surface for hot stretch forming into a body panel or the like.

SUMMARY OF THE INVENTION

This invention pertains to hot stretch forming of sheet metal parts in combination with sheet metal reinforcing pieces. The method is particularly applicable to the high temperature forming of automotive vehicle body panels from magnesium and manganese containing aluminum alloys, such as AA5083, under superplastic forming conditions or quick plastic forming conditions. The practice of the invention will be illustrated in the forming of a one-piece AA 5083 sheet metal vehicle floor pan with reinforcement pieces for anchoring seat assemblies to a portion of the passenger compartment floor panel. However, it is to be understood that the invention is applicable generally to high temperature sheet metal stretch forming operations where patches or reinforcing sheets are to be attached to a main sheet metal part.

Hot stretch forming of sheet metal alloys typically uses at least two opposing and complementary tools that are heated to a suitable forming temperature for the sheet material. In the case of AA5083 sheet this temperature is typically near 500° C. The tools are moved between an open position for removal of a finished part and insertion of a new sheet metal blank, and a closed position in which the edges of the blank are gripped and gas pressure is applied to form the panel. A tool on one side of the blank provides the forming surface for the part such as a vehicle door or tailgate panel or body floor pan. An opposing tool on the other side of the sheet provides a chamber for application of pressurized gas. In accordance with this invention one or more reinforcing sheet metal pieces is placed on the hot forming tool in a predetermined location for forming of the reinforcement piece against the portion of the sheet that is to be reinforced in the finished part.

The reinforcing sheet(s) is typically somewhat smaller than the primary part to which it is to be attached. The piece must be located on the forming tool surface so that it is formed against the appropriate surface region of the part. The forming tool may have been preheated or it is heated as part of the forming operation. Accordingly, one or more locator features are formed or embedded in the forming tool surface where the reinforcing piece is to be formed. For example, a locator pin or a tool surface shape is suitable for this purpose. One or more corresponding locator holes or notches are formed in each reinforcing piece. Then a robot arm or other placement mechanism can place the reinforcing piece on the locator pin on the forming tool surface. The length of the pin or locating tool surface feature extending above the forming tool surface is specified to secure the position of the reinforcement sheet without damaging or undesirably altering the shape of the principal sheet.

The sheet metal blank is then inserted between the open tools and the press mechanism closes them against the edges of the sheet for the stretch forming operation. Applied gas pressure stretches the larger blank against the trapped reinforcing pieces and against the forming tool surface. The floor pan and the reinforcing pieces are shaped at the same time and the formed panel and formed reinforcing pieces are removed from the tools. The nature of the removal of the co-formed sheet parts depends largely on their respective shapes. Sometimes the parts are mechanically attached by the forming process and are removed together from the forming surface. Sometimes the parts are removed separately. Sometimes a bonding agent is used to attach the parts and they are removed together. But the general intent of the invention is that the formed-to-shape sheet parts will be attached in the completed assembly. For example, in the manufacture of the floor pan the reinforcing pieces are welded to it or otherwise attached after the forming step.

The reinforcing pieces may be formed on top of a forming tool surface and this practice will result in an offset in the primary panel surface. Alternatively, suitable recesses for the reinforcing pieces may be made in the surface of the forming tool so that the shape of the principal part is not affected by the interposed reinforcing piece. During the forming of the reinforcing pieces, markings for identification may be imprinted on their surfaces for later use in attaching them at the appropriate location on the finished and cooled part.

In this illustration, several reinforcing pieces for attachment of seat assemblies to a vehicle floor pan may be shaped at the same time that the floor structure itself is formed. After the floor panel is cooled and trimmed, etc, the reinforcing pieces are fastened, e.g. welded, to the panel at the seat attachment locations.

Thus, this invention provides a method for location of small sheet metal reinforcing or patching pieces on a hot forming tool surface for forming simultaneously with a larger sheet metal part. Other objects and advantages of the invention will be apparent from a detailed description of specific embodiments which follows.

DESCRIPTION OF PREFERRED EMBODIMENTS

Figure 1:
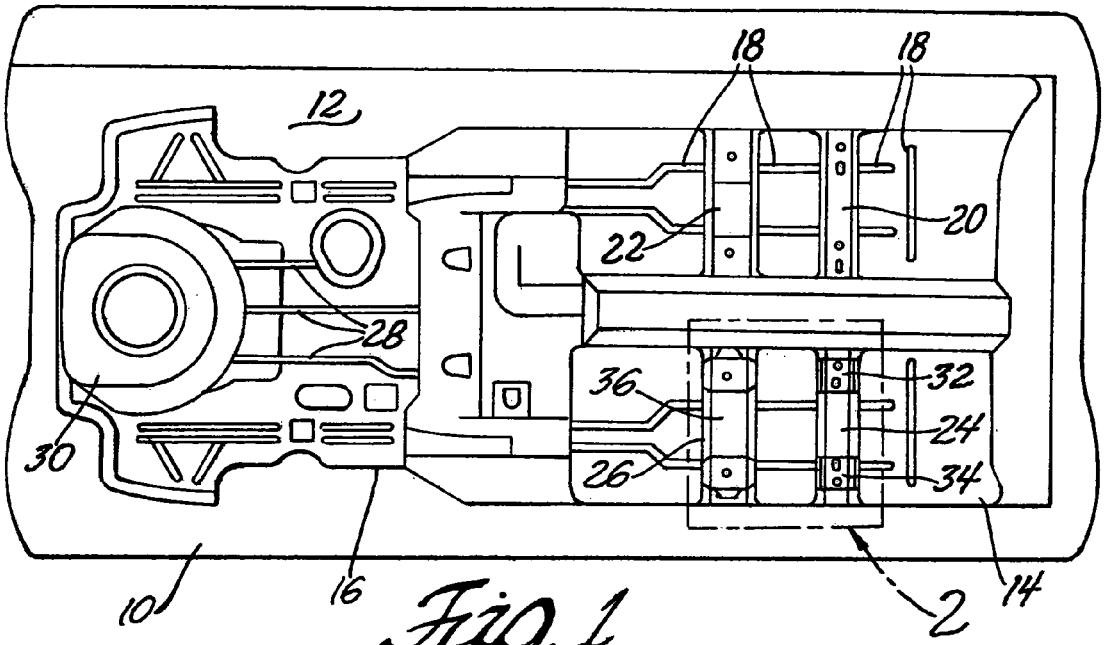
FIG. 1 is a plan view of a formed sheet metal vehicle floor pan showing regions on the shaped part where correspondingly shaped smaller reinforcing pieces are to be attached.

High elongation magnesium and manganese containing aluminum alloy sheet stock can be hot stretch formed into intricate shapes such as are required in automotive body panels. An example of this practice is described in U.S. Pat. No. 6,253,588, entitled Quick Plastic Forming of Aluminum Alloy Sheet Material. This '588 patent is assigned to the assignee of this invention and its disclosure of such hot stretch forming is incorporated into this specification by reference.

An example of a commercial superplastic formable aluminum alloy which is used in quick plastic forming or related superplastic forming practices is aluminum alloy 5083. AA5083 has a typical composition, by weight, of about 4 percent to 5 percent magnesium, 0.3 to 1 percent manganese, and maximum amounts of about 0.25 percent chromium, about 0.1 percent copper, about 0.3 percent iron, and about 0.2 percent silicon and the balance substantially all aluminum. Generally a homogenized ingot of the cast alloy is hot rolled and then cold rolled to a desired sheet thickness from about 1 to about 4 millimeters. In its high elongation form, cold rolled AA5083 sheet material is recyrstallized to have a microstructure characterized by finely dispersed particles of intermetallic compounds with a grain structure of about 10 micrometers or less.

The sheet material is shaped in a hot stretch forming process. The edges of a suitable sheet blank that has been preheated to a forming temperature are gripped between opposing, complementary hot forming tools. One of the tools is shaped to provide a forming surface against which the hot sheet is pressed and stretched. The opposing tool defines a pressure chamber on the opposite side of the sheet for application of a pressurized working gas. The tools may be placed in a heated press or they may be internally heated with resistance heating elements to a suitable hot forming temperature typically in the range of about 450° C. to 510° C. The tools are carried in a press structure in which one tool is typically stationary and the other tool is moved between open and closed positions. The sheet is inserted between opened tools and they are closed to grip the edges of the sheet. High pressure gas introduced in the tool chamber on one side of the sheet pushes and stretches the sheet into conformity with the shape defining surface of the other tool.

The stretch forming of the hot sheet against the internally heated and insolated tools typically requires about 60 to 150 seconds depending upon the size and shape of the part and the formability of the sheet metal material. Sometimes it is desired to provide an additional sheet layer of reinforcing material for attachment to one side of the hot stretch formed sheet product. The overall thickness and shape of the hot formed sheet product provides adequate strength for its application over most of its surface area. However, sometimes it is desired to provide additional thickness of sheet reinforcement in selected areas of the sheet. For example, an automobile floor pan can be formed of a large sheet (for example, 1230 mm by 3060 mm by 1.3 mm) of AA5083 aluminum alloy. Rails for seat assemblies will later be attached to the floor pan sheet and it may be desirable to attach a strip of reinforcing AA5083 sheet material to one side of the floor pan where the rails are to be attached. Typically such reinforcing strips are formed separately from the hot forming operation of the main panel. The reinforcing strips are not particularly large and can be formed to more or less match the shape at the portion of the main panel to which they are to be attached. This invention provides a practice by which the reinforcing strips can be formed at the same time as the main panel and at the intended location to which they will be later attached in an assembly operation.

FIG. 1 is a schematic plan view of the bottom surface 12 of a one-piece hot stretch formed AA5083 floor pan 10 for a car. Bottom surface 12 was in direct contact with the heated stretch forming tool which is not shown except for the portions of the tool shown in FIGS. 3, 4 and 5. Bottom surface 12 is not flat but shaped to underlie the vehicle passenger compartment (front end 14) and the trunk compartment (rear end 16). The front end 14 of floor pan 10 is shaped with fore-aft and transverse stiffening channels 18 and four transverse channels 20, 22, 24, and 26 for supporting seat rails. The rear end 16 of floor pan 10 also contains integrally formed features such as reinforcing channels 28 and spare tire well 30. However, the shape features of floor pan 10 that are of significance in the practice of the subject invention are transverse channels 20–26 for supporting seat rails and the driver seat and passenger side seat assemblies, not shown.

Transverse channels 20 and 22 support a passenger seat assembly and transverse channels 24 and 26 underlie seat rails for a driver seat. Since floor pan 10 is viewed from its bottom side 12, the transverse channels 20–26 each extend upwardly into the plane of FIG. 1 and are steeply trapezoidal in cross-section. In the assembly of a vehicle incorporating floor pan 10 two shaped reinforcement parts 32 and 34 will be welded into channel 24 and a shaped part 36 will be welded into channel 26. Identical reinforcement parts, not shown, are also welded into passenger seat channels 20 and 22. In accordance with this invention, reinforcing parts 32, 34 and 36 are formed on the hot forming tool at the same time that floor pan 10 is hot stretch formed on the tool. The practice of the invention will be illustrated with respect to the forming of sheet reinforcing parts for channels 24 and 26. But like reinforcing parts would be formed simultaneously in and with the forming of transverse channels 20 and 22.

Figure 2:
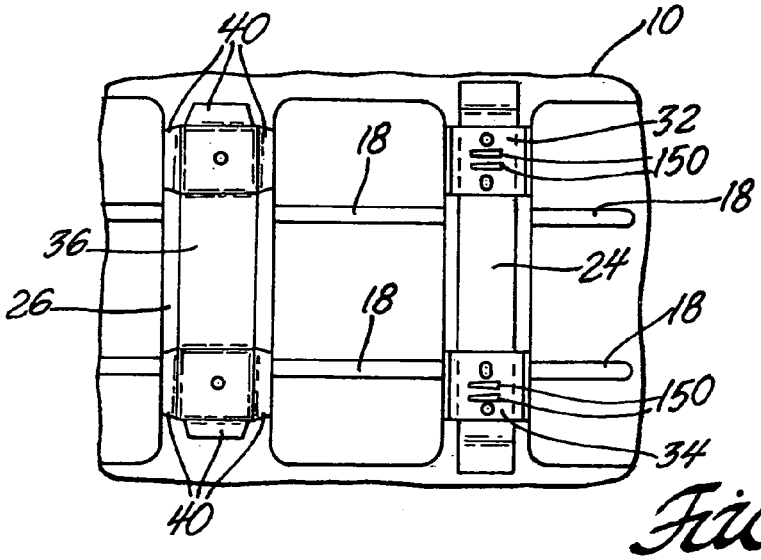
FIG. 2 is an enlarged view of region 2 of FIG. 1 showing the shaped and attached reinforcing pieces.

FIG. 2 is an enlarged schematic view of region 2 of FIG. 1. The illustrated portion of floor pan 10 shows longitudinal stiffening channels 18 and front transverse channel 24 and rear transverse channel 26 for the driver seat rails. Spanning the bottom and sides at two spaced locations of channel 24 are two initially rectangular reinforcing sheets 32 and 34 that have been shaped to the channel cross-sectional profile. Fitted into channel 26 and lying along its axis is reinforcing piece 36. Reinforcing piece 36 has a central strip portion with three tabs 40 at each end. Reinforcing piece 36 is shaped to lie in channel 26. In the assembly of floor pan 10, the three reinforcing pieces 32, 34, and 36 are respectively welded in the channels 24 and 26 in the locations shown in FIGS. 1 and 2. In prior art practice, these strips would be simply separately formed and then eventually welded into channels 24 and 26 (with like reinforcing pieces welded in channels 20 and 22) after the hot stretch formed sheet metal floor pan 10 had been cooled, trimmed and was otherwise ready for assembly into a vehicle body structure. In accordance with this invention, the reinforcing pieces are formed from sheet metal blanks at the same time as the floor pan is shaped and in the position on the floor pan at which they will ultimately be attached.

As stated, integrally heated forming tools are prepared for the hot stretch forming of floor pan 10 and its reinforcing pieces such as pieces 32, 34 and 36. The principal forming tool provides detailed shape of the floor pan 10 that is illustrated in FIG. 1. A complementary tool provides the chamber for pressurized gas on the opposite side of the sheet. These tools are not shown in their entirety. But FIG. 3 is a broken-away portion, partly in cross-section, of forming tool 110 for the shaping of floor pan 10 in the region of channels 24 and 26.

Floor pan forming tool 110 includes relieved channel surfaces 118 for forming longitudinal reinforcing channels 18 in floor pan 10. The illustrated portion of tool 110 also contains upstanding forming surfaces 124, 126 for transverse reinforcing channels 24 and 26 in floor pan 10. Shown elevated above tool 110 in FIG. 3 are flat sheet metal blanks 132, 134 and 136. These flat blanks are trimmed and shaped to be formed, respectively into reinforcement pieces 32, 34 and 36. Holes 138 or slots 140 are formed in the blanks for the reinforcing pieces. Holes 138 and/or slots 140 are sized and located in trimmed blanks 132, 134 and 136 to enable the blanks to be suitably placed over locator pins 144 on the channel forming members 124 and 126 of forming tool 110. The round locator pins 144 are simply illustrative of a variety of shapes of locating elements that can be formed in, or inserted in, the surface of forming tool 110 to position the blank reinforcing pieces within location tolerances required for the suitable shaping of the reinforcing pieces against the principal panel part. Similarly the location and shape of the slots or holes are illustrative of the complementary locating features cut into the reinforcing blanks to place them on the hot forming tool surface for subsequent stretch forming when pressed against the surface by an overlying panel blank as is illustrated in FIG. 4.

Figure 3:
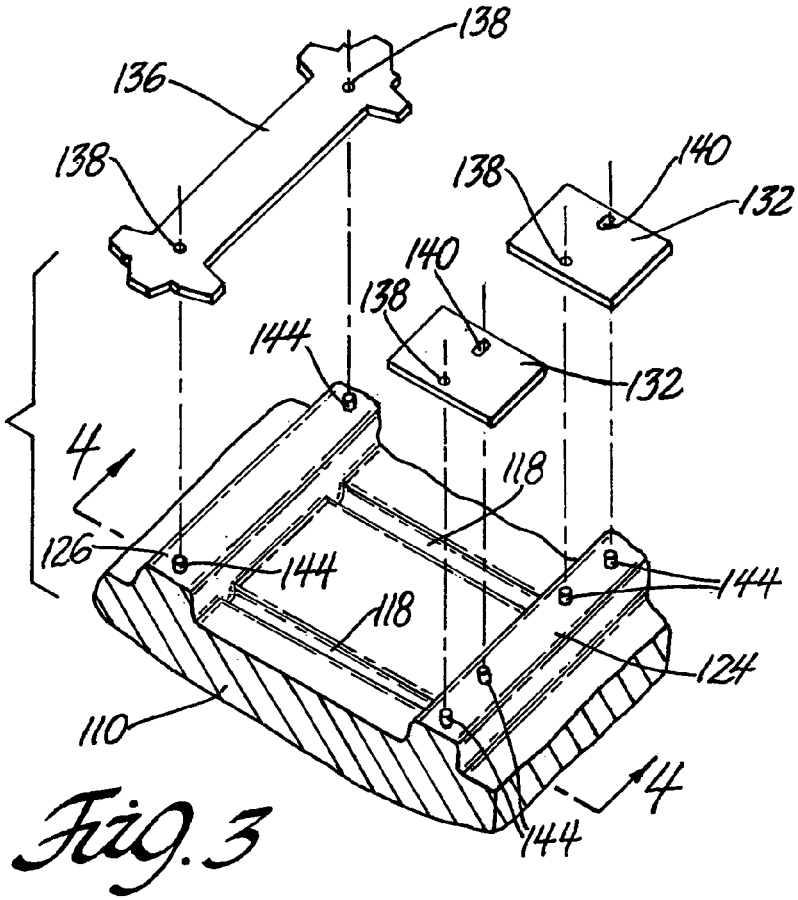
FIG. 3 is an oblique view of a portion of a forming tool showing locator pins for two reinforcing pieces. The blanks for the reinforcing pieces are shown aligned above the tool and locator pins.

Thus it is contemplated that when the press is opened and the forming tool, a portion of which is shown in FIG. 3, and the complementary chamber defining tool, which is not illustrated in FIG. 3, are opened a mechanical robot or other part positioning device can be employed to place the blanks 132, 134, 136 for the reinforcing pieces against the hot tool 110 with the holes 138 and/or slots 140 of the blanks 132, 134, 136 fitted around the locating pins 144. Holes 138 are sized to permit easy fitting of the blank over a locating pin 144 and shaping of the blank during hot stretching. Slots 140 are useful in directions in which the blank may experience substantial elongation. Preferably the heights of the locating pins 144 are determined so that they do not impress an unwanted hole or cavity in the surface of the main sheet metal blank or part 10.

The blanks 132, 134, 136 of the reinforcing pieces are placed on the hot tool 110 suitably before the large sheet metal blank, not shown, for the main panel structure is placed over the forming tool and gripped at the edges of the tool and the edges of the sheet for the hot stretch forming operation. Gas pressure is admitted to the other side of the sheet metal blank and the sheet metal blank is pressed and draped into conformance with the whole of the forming tool 110. At the same time that the main sheet is being formed it exerts pressure on the now hot blanks 132, 134, 136 of reinforcing material and they too are shaped in conformity with the surface of forming tool 110.

Figure 4:
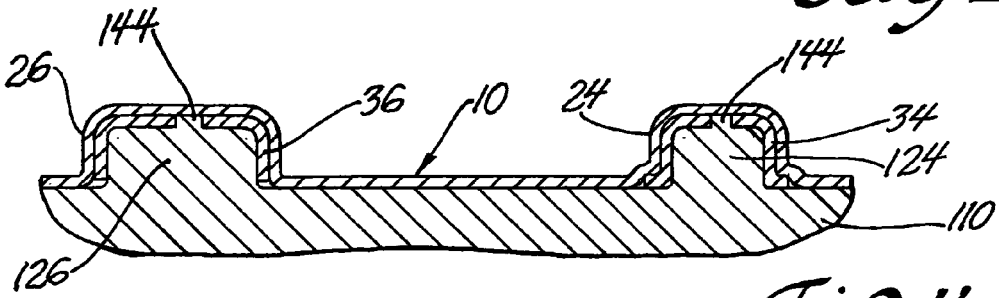
FIG. 4 is cross-sectional view of FIG. 3 in direction 4—4 showing the tool, locator pins, formed reinforcing pieces and overlying formed floor panel.

FIG. 4 is a cross-sectional view of a portion of heated forming tool 110, the floor pan panel 10 in the region of the reinforcing channels 24, 26. Reinforcing pieces 34, 36 are formed complementary to the adjacent surfaces of the floor pan panel 10. In this embodiment no recess was provided in tool 110 for the reinforcing parts 32, 34, 36. As seen in FIG. 4 the portions of the floor pan 10 overlying the edges of reinforcing parts 34, 36 are displaced around the edges. In applications in which this displacement is not desired or tolerable the surface of tool 110 can be suitably recessed to receive reinforcements 34, 36 without affecting the shape of floor pan 10.

As further illustrated in FIG. 4, reinforcing pieces 34 and 36 are not likely to be mechanically trapped by floor pan panel 10 when the panel is removed vertically from tool 110. As seen in FIG. 4, panel 10 does not enclose the ends of either reinforcing piece 34 or 36 so as to enclose them upon vertical lifting of the panel. The reinforcing pieces will likely be removed from tool 110 after panel 10 has been lifted away. However, in the case where the sides of a reinforcing piece, such as either piece 34 or 36 do not extend down the full vertical length of the respective channel forming surface portion, 124 or 126, panel 10 may be pushed around the ends of the reinforcing piece during hot forming, mechanically trapping it. In this case, a reinforcing piece will be mechanically secured by an overlying formed sheet metal part and carried with the part when it is lifted from the forming tool surface.

After the 60 to 110 seconds or so of the forming operation, the forming tools are opened and the floor pan panel 10 is carefully removed from the forming tool 110 as are the reinforcing pieces 32, 34, 36. The floor pan 10 and reinforcing pieces 32, 34, 36 are cooled and subjected to any trimming or finishing operations that may be required. They are later brought together for welding of the reinforcing pieces 32, 34, 36 against the bottom side of reinforcing channels 24, 26 of floor panel 10.

Figure 5:
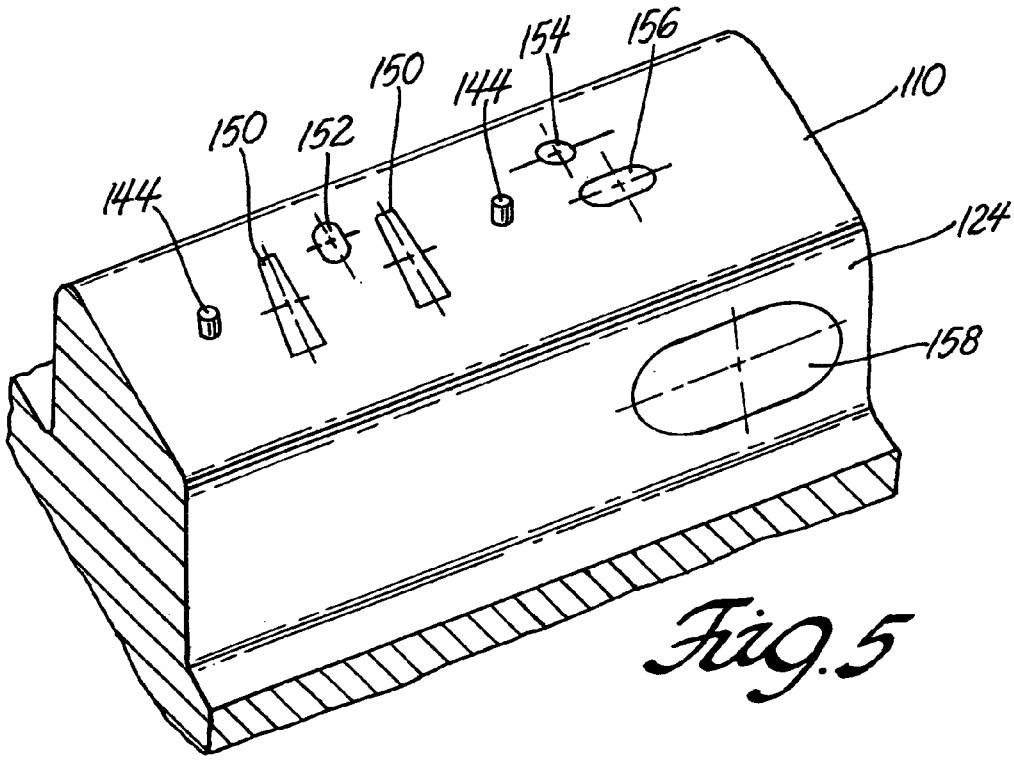
FIG. 5 is a view of a portion of the forming tool of FIG. 3 showing identification symbols for impressing on a reinforcement piece as it is being formed.

It is recognized that a large stretch formed part like a floor pan may require several reinforcing pieces that are to be attached later to the formed panel after cooling and trimming. In accordance with this invention, identification markings or symbols may be imprinted or embossed in the reinforcing pieces as they are being formed against the main panel. FIG. 5 illustrates a portion 124 of forming tool 110 for forming the channel 24 in floor pan 10 and reinforcing piece 32 or 34. As the reinforcing piece is being formed on tool surface 124 it can be imprinted with one or more identifying markings such as those illustrated at 150, 152, 154, 156, or 158 formed in surface 124 of tool 110. For example, markings 150 are seen on reinforcement s 32 and 34 in FIG. 2.

While the invention has been described in terms of this illustrative embodiment, it will be appreciated that other sheet metal materials could be formed and other objects with reinforcing sections could be formed. Accordingly, it is to be understood that the invention is not to be limited by the specific illustrations by only by the scope of the following claims.

The invention claimed is:

1. A method of stretch forming a sheet metal part having a predetermined three-dimensional configuration together with a reinforcing sheet metal piece to be located on a portion only of the configuration of the part, the method comprising:

placing a blank for the reinforcing piece with a locator hole on a forming tool surface, the forming surface defining the three-dimensional configuration of the part and having a locator pin at the portion of the configuration for the locator hole of the reinforcing piece blank, the locator hole of the blank being placed over the locator pin;

hot stretch forming said sheet metal part from a sheet metal blank for the part against said forming surface to said three-dimensional configuration while simultaneously forming said reinforcing piece at the portion of said configuration;

removing the formed sheet metal part and formed reinforcing piece from the forming tool surface; and thereafter attaching the reinforcing piece to the part at the portion of the part configuration.

2. The method of stretch forming a sheet metal part as recited in claim 1 in which the part and reinforcing piece are both formed of a superplastic formable aluminum alloy.

3. The method of stretch forming a sheet metal part as recited in claim 1 in which the part and reinforcing piece are both formed of a superplastic formable aluminum alloy and the forming surface is heated to a temperature over 400° C.

4. The method of stretch forming a sheet metal part as recited in claim 1 in which the reinforcing piece is thicker than the sheet metal part.

5. The method of forming a sheet metal part as recited in claim 1 in which the locator hole in the blank for the reinforcing piece is slotted to permit axial elongation of the blank along the axis of the slot.

6. The method of forming a sheet metal part as recited in claim 1 in which the forming tool surface is recessed to receive the reinforcing piece.

7. A method of stretch forming a superplastic, magnesium containing, aluminum alloy sheet metal part having a predetermined three-dimensional configuration together with a reinforcing sheet metal piece to be located on a portion only of the configuration of the part, the method comprising:

placing a blank for the reinforcing piece with a locator hole on a forming tool surface heated to a temperature above 400° C., the forming surface defining the three-dimensional configuration of the part and having a locator pin at the portion of the configuration for the locator hole of the reinforcing piece blank, the locator hole of the blank being placed over the locator pin;

stretch forming said sheet metal part from a preheated sheet metal blank for the part against said forming surface to said three-dimensional configuration while simultaneously forming said reinforcing piece at the portion of said configuration;

removing the formed part and formed reinforcing piece from the forming tool surface; and thereafter attaching the reinforcing piece to the part at the portion of the part configuration.

8. The method of forming a sheet metal part as recited in claim 7 in which the locator hole in the blank for the reinforcing piece is slotted to permit axial elongation of the blank along the axis of the slot.

9. The method of forming a sheet metal part as recited in claim 7 in which the forming tool surface is recessed to receive the reinforcing piece.

10. The method of forming a sheet metal part as recited in claim 7 in which the part is a floor pan for a vehicle and the reinforcing piece is reinforcement of the floor pan for attachment of a seat assembly.

* * * * *